US005802612A

United States Patent [19]

Hosking

[11] Patent Number: 5,802,612

[45] **Date of Patent: *Sep. 8, 1998**

[54] CLOTHING CONJOINER

[76] Inventor: Louis R. Hosking, 4575 W. 80th St. Cir., No. 223, Bloomington, Minn. 55437

[ * ] Notice: The term of this patent shall not extend beyond the expiration date of Pat. No. 5,515,544.

[21] Appl. No.: 380,622

[22] Filed: Jan. 30, 1995

[51] Int. Cl.[6] ..... A41F 1/00

[52] U.S. Cl. ..... 2/107; 2/112; 2/117; 2/223; 2/323; 24/304

[58] Field of Search ..... 2/107, 112, 117, 2/223, 323; 450/81, 112, 109, 110; 24/DIG. 11, 304; 428/40, 124, 130

[56] References Cited

U.S. PATENT DOCUMENTS

| | | | |
|---|---|---|---|
| 2,030,135 | 2/1936 | Carpenter | 450/81 |
| 2,292,024 | 8/1942 | Dreher | 450/81 |
| 2,360,953 | 10/1944 | Lippman | 2/232 |
| 3,503,078 | 3/1970 | Gallian | 2/311 |
| 3,590,390 | 7/1971 | Howard | 2/312 |
| 3,947,896 | 4/1976 | Taylor | 2/217 |
| 4,078,266 | 3/1978 | Brown | 2/240 |
| 4,621,442 | 11/1986 | Mack | 428/130 X |
| 4,726,972 | 2/1988 | Instance | 428/130 X |
| 5,266,371 | 11/1993 | Sugii et al. | 428/40 |

*Primary Examiner*—Jeanette E. Chapman

[57] ABSTRACT

A removable clothing conjoiner to attach the waistband of a pants or skirt to a user's shirt or blouse. The base of the conjoiner is made of a material or dimensioned so that it is stiffer in one direction than the other, with the stiffer direction being aligned vertically, thereby preventing rolling, folding, or bunching of the material during use while allowing flexibility in the horizontal direction. The base is coated with adhesive, and the adhesive is covered by removable liners which the user peels off when applying the conjoiner to his/her clothing. The removal tab permits easy separation of the liners from the conjoiner and also permits easy removal of the conjoiner from the clothing so that it can be discarded after use.

5 Claims, 2 Drawing Sheets

CLOTHING CONJOINER

BACKGROUND OF THE INVENTION

Some men, especially those of large girth or with a paunch, experience the disconcerting feeling of their trousers sliding down their stomach and the sloppy bunching of the trousers over their shoes. The unbecoming result is an accentuated protruding stomach. Others, while wearing a suit or shirt and trousers, experience their shirt pulling or twisting out during the course of normal activities throughout the day. Again, the result is an unkempt appearance with the shirt forming a baggy bulge at the belly. Women also experience this slippage problem due to stretching and twisting motions in normal every day activities while wearing a blouse and skirt or slacks.

There are disadvantages with some methods and means currently being used. Belts are of no help for beltless-style trousers or for men with protruding abdomens. Belts do not stop shirts from pulling or twisting out from belt-style trousers. Suspenders can cause discomfort by pulling trousers up too far. They also add another cause to the problem of shirts pulling out. Buttons are bulky and not feasible for many combinations of clothing. A butterfly bandage shaped adhesive strip as shown in U.S. Pat. No. 3,947,896 lacks sufficient vertical rigidity and fails to lock the garment in both horizontal and vertical directions.

For the foregoing reasons there is a need for an article that can join separate and distinct articles of clothing to ameliorate or eliminate some of the problems previously mentioned.

For many years, the inventor has been experimenting with different types of clothing conjoiners to solve these problems. Originally, strips of ordinary double-backed tape were tried, but within a few hours of use they would roll into an ineffective wad of adhesive material. It wasn't until the inventor experimented with a backing which was relatively stiff in the vertical direction while still maintaining flexibility in the horizontal direction that success was achieved. The current invention employs a backing which, being relatively stiff in the vertical direction, will not fold, roll, or bunch while being worn between the waistband of pants or skirts and a shirt or blouse. The use of backing which is relatively flexible in the horizontal direction permits the body movement which is necessary for comfortable wearing of the pants or skirts.

SUMMARY OF THE INVENTION

This invention relates generally to a clothing fastener, and more particularly to a clothing fastener which has an adhesive attachment assembly and liners.

An object of the present invention is to provide a fastener to help keep trousers or skirts from slipping down one's stomach. Another object is to provide a fastener to control the amount of shirt or blouse which can pull out from trousers, slacks or skirt in order to present a neat appearance throughout the day. A further object of the invention is to convert separate articles of apparel, such as a shirt and pants, into a single unitary outfit. For example, the invention can give a shirt and trousers the characteristics of a jumpsuit. The invention allows the shirt or blouse to hold trousers or a skirt in the desired vertical position while the weight of the trousers or skirt pull down and straighten out the shirt or blouse.

According to the present invention, the foregoing and other objects are attained by using a clothing conjoiner between two articles of clothing.

The invention calls for a suitable base material, cut to an appropriate size, adhesive on the base material to create an attachment assembly, a removal tab at one end of the resulting attachment assembly, and liners over both sides of the attachment assembly. The base of the conjoiner is made of a material or is dimensioned so as to be relatively more stiff in one direction than the other, the stiffer direction being aligned vertically to prevent rolling, folding, or bunching of the material during use while allowing flexibility in the horizontal direction to give the desired wearing comfort. The removal tab is used to make it easy to remove the attachment assembly after use. It also eases the process of getting a grip on the liners and facilitates the initiation of a peeling motion when removing the liners.

The invention is intended to join two articles of clothing such as, but not limited to, trousers and a shirt, slacks and a blouse, skirt and a blouse, and shorts and a shirt. Other objects will become apparent to one skilled in the art through study of this disclosure.

In using the invention, the user first takes the conjoiner and utilizes the removal tab on the attachment assembly to get a grip on the outer liner so he/she can remove the liner from the conjoiner, then applies the adhesive coated attachment assembly to the interior of the waistband of pants or a skirt. The user then dons the pants or skirt and the shirt or blouse and adjusts the combination as he/she prefers. After adjustment, the user removes the inner liner from the inner face of the conjoiner and pats the clothing to create bonding between the attachment assembly and the shirt or blouse.

DETAILED DESCRIPTION OF THE INVENTION

Figure 1:
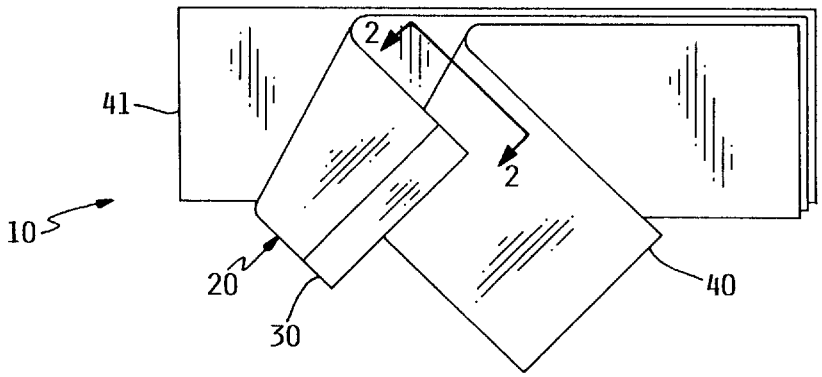
FIG. 1 is a side elevational view of a clothing conjoiner, in its orientation of normal use, with parts partially pulled back for illustrative purposes.

Referring now to the drawings, wherein like reference numerals designate like or corresponding parts throughout the several views, FIG. 1 illustrates a preferred embodiment of the clothing conjoiner of this invention. The clothing conjoiner 10 has three primary components, an attachment assembly 20, a removal tab 30, and liners 40.

The liners 40 are used to prevent premature adherence of other objects to the attachment assembly 20; they have the qualities of adhering to adhesive 24 but of being easily peelable from the adhesive by the user.

The attachment assembly 20 comprises a base 22 and an adhesive 24.

The base 22 of the attachment assembly 20 is relatively stiff in one direction while at the same time being relatively flexible in the perpendicular direction. As shown in FIG. 1, the base 22 of the attachment assembly 20 is made so as to be relatively more rigid in the vertical direction running across the width of the attachment assembly 20, and relatively more flexible in the horizontal direction, running along the length of the attachment assembly. It is important to the invention that the base 22 be dimensioned or made of a material so it is relatively more stiff in one direction than the other, with the stiffer direction being aligned vertically, so as to prevent rolling, folding, or bunching of the material during use while allowing flexibility in the horizontal direction to provide the desired wearing comfort. The size and shape of the base 22 varies depending upon the types of clothing to be joined.

The base 22 is between one-quarter inch and two inches wide and between two and eight inches long. In a preferred embodiment the base 22 is between three-quarter inch and one and one-quarter inches in width and between three and)six inches in length. In one particular embodiment, the base 22 is one inch wide and four inches long.

The adhesive 24 is disposed on both sides of the base 22 of the attachment assembly 20. The adhesive 24 includes, but is not limited to, a material which has the qualities of being permanently attachable to the base material, which will be peelable from later-applied liner materials, and which will adequately grip, but be peelable from, articles of clothing.

Figure 2:
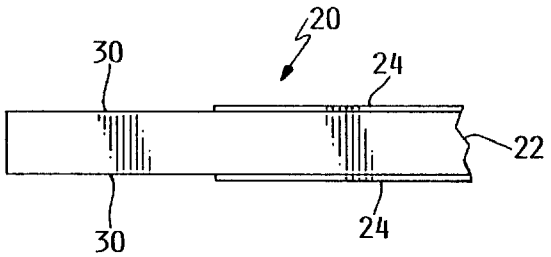
FIG. 2 is a top plan view of an enlarged portion of the attachment assembly with the removal tab in place.

FIG. 2 depicts an enlarged portion of the attachment assembly 20. The attachment assembly 20 comprises a base 22 with adhesive 24 on both sides of the base, and a removal tab 30.

The removal tab 30 comprises the base 22, the adhesive 24, and non-adhesive area 32. In FIG. 1 and FIG. 2 the removal tab 30 is shown at a terminal end of the base 22 of the attachment assembly 20. The removal tab 30 facilitates placement and removal of the attachment assembly 20. The removal tab 30 comprises a non-adhesive area 32 on the attachment assembly 20. The non-adhesive area 32 is shown in FIG. 2 to be located on each side of the attachment assembly 20. The removal tab 30 may be made by excluding adhesive 24 from the terminal end of the base 22 or by attaching non-adhesive material to the end of the attachment assembly 20. Alternative suitable locations for the removal tab 30 on the attachment assembly 20, such as running the removal tab 30 along a portion of the top or bottom of the attachment assembly 20 will also work, but are not the preferred locations.

The method of using the invention will be described in further detail. The user starts by holding the clothing conjoiner 10. After grasping one of the liners 40 at the location in which the removal tab 30 has prevented adhesion between the liner and the attachment assembly 20, the user peels off the liner 40. Next, the user sticks the exposed adhesive 24 of the clothing conjoiner 10 to the inner surface of the waistband of his/her pants or skirt. Following that, the user dons the pants or skirt and the shirt or blouse and arranges them as desired. The final step is the removal of the second liner 40 from the clothing conjoiner 10 and pressing the exposed adhesive 24 against the surface of the shirt or blouse to create the desired bond between the upper and lower garments.

When the user undresses and is through using the attachment assembly 20, it is easily removed from the pants or skirt by gripping the removal tab 30 and peeling the attachment assembly 20 from the apparel and discarding it.

Figure 3:
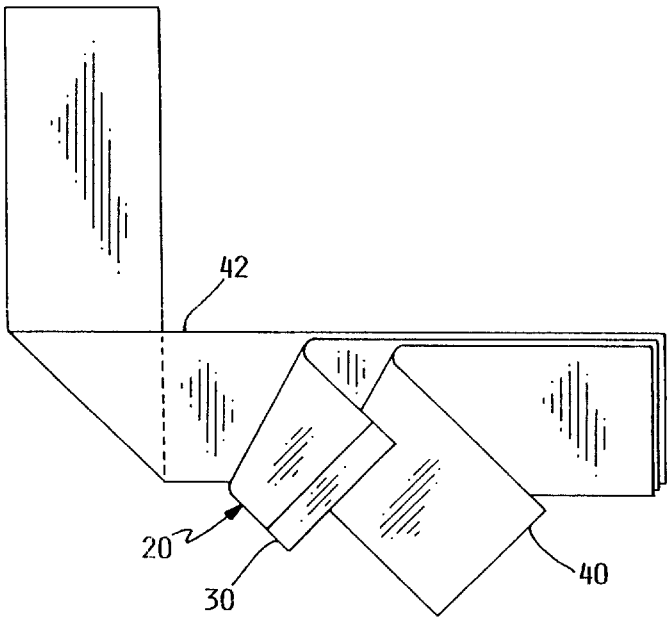
FIG. 3 is a side elevational view of an alternative embodiment of the invention.
Figure 4:
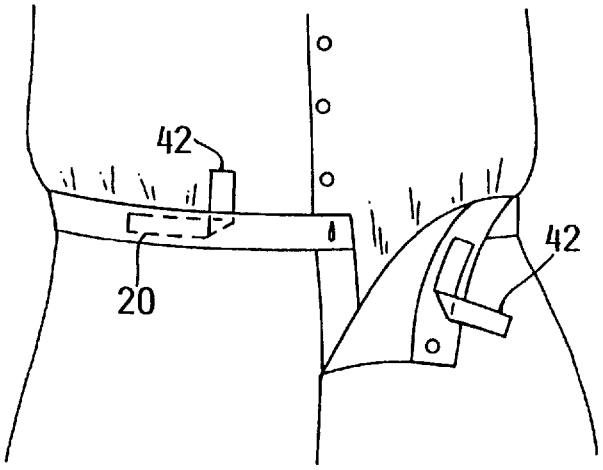
Figure 5:
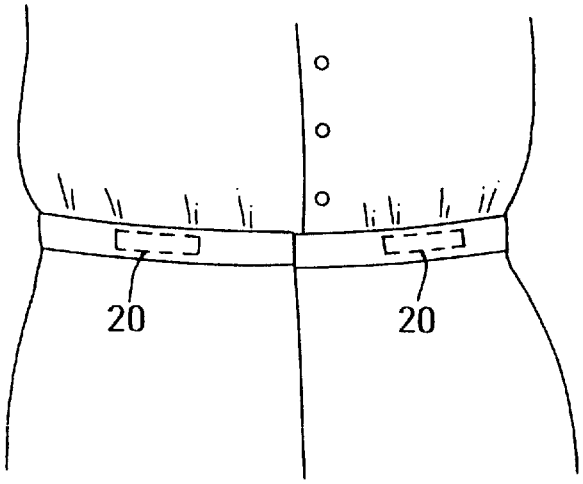

For users who desire to place the clothing conjoiner 10 further down from the top of the waistband to keep it out of sight, and for those whose waistbands are too tight to facilitate easy removal of the second liner 40, the alternative embodiment shown in FIG. 3 may be more useful. The alternative clothing conjoiner comprises an exposure liner 42 and a grip liner 44 instead of the liners 40. The material used for the exposure liner 42 and the grip liner 44 have similar qualities to that used for the liners 40. The exposure liner 42 is identical to liner 40. The grip liner 44 is cut to a greater length than the length of the attachment assembly 20 and the excess length may be folded so that the grip liner extends vertically above and beyond the waistband for convenient removal of the grip liner after the user's clothing is in place.

The final step of using this alternative embodiment is to grip the grip liner 44 at its extension above the waistband and remove it from the lower garment with a pulling motion; then pressing the exposed adhesive 24 against the surface of the shirt or blouse creates the desired bond between the garments.

I claim:

1. A clothing conjoiner which comprises:

a) a base dimensioned or made of a material so that it is relatively stiffer in one direction than in the direction perpendicular to it;

b) the dimensioned base material being called a base;

c) an adhesive with the qualities of being permanently attachable to the base material, peelable from later-applied liner materials, and gripping to but peelable from clothing fabrics, applied to both sides of the base to form an attachment assembly;

d) a non-adhesive removal tab along one edge of the attachment assembly;

e) two liners, an inner liner and an outer liner, wherein 1) the liners are made of material which adheres to the adhesive coating of the base until removed by the user, and which is easily peelable from the adhesive by the user, 2) the outer liner is cut to substantially conform to the shape of the attachment assembly, and 3) the inner liner is cut to the width of the attachment assembly and to a length greater than that of the attachment assembly f) the excess length of the inner liner may be folded upward in a direction perpendicular to the length of the attachment assembly so as to form a tab to allow for ease of removal of the inner liner after the conjoined garments are in place on the user.

2. The clothing conjoiner of claim 1, wherein the base has a dimension of between one-quarter inch and two inches in the stiffer direction and a dimension of between two inches and eight inches in the more flexible direction.

3. The clothing conjoiner of claim 1, wherein the base has a dimension of between three-quarter inch and one and one-quarter inch in the stiffer direction and a dimension of between three inches and six inches in the more flexible direction.

4. The clothing conjoiner of claim 1, wherein the base has a dimension of one inch in the stiffer direction and a dimension of four inches in the more flexible direction.

5. A clothing conjoiner which comprises:

a) a base dimensioned or made of a material so that it is relatively stiffer in one direction than in the direction perpendicular to it;

b) the dimensioned base material being called a base;

c) an adhesive with the qualities of being permanently attachable to the base material, peelable from later-applied liner materials, and gripping to but peelable from clothing fabrics, applied to both sides of the base to form an attachment assembly;

d) a non-adhesive removal tab along one edge of the attachment assembly;

e) two liners, an inner liner and an outer liner, wherein 1) the liners are made of material which adheres to the adhesive coating of the base until removed by the user, and which is easily peelable from the adhesive by the user, 2) the outer liner is cut to substantially conform to the shape of the attachment assembly, and 3) the inner liner is cut to the width of the attachment assembly and to a length greater than that of the attachment assembly f) the excess length of the inner liner may be folded so as to form a tab to allow for ease of removal of the inner liner after the conjoined garments are in place on the user.

* * * * *